US009393817B2

(12) United States Patent
Murata

(10) Patent No.: US 9,393,817 B2
(45) Date of Patent: Jul. 19, 2016

(54) PRINTER WITH A CUTTER

(71) Applicant: SEIKO INSTRUMENTS INC., Chiba-shi, Chiba (JP)

(72) Inventor: Tomohiro Murata, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/620,985

(22) Filed: Feb. 12, 2015

(65) Prior Publication Data

US 2015/0251459 A1 Sep. 10, 2015

(30) Foreign Application Priority Data

Mar. 7, 2014 (JP) ..... 2014-045509

(51) Int. Cl.
*B41J 11/70* (2006.01)
*B41J 15/04* (2006.01)

(52) U.S. Cl.
CPC ..... *B41J 11/70* (2013.01); *B41J 15/042* (2013.01)

(58) Field of Classification Search
CPC ..... B41J 11/70; B41J 11/66; B41J 11/007; B41J 11/06; B41J 11/04
See application file for complete search history.

(56) References Cited

U.S. PATENT DOCUMENTS

| | | | | |
|---|---|---|---|---|
| 6,831,670 | B2 * | 12/2004 | Fujiwara | 347/222 |
| 2009/0279935 | A1 * | 11/2009 | Kawaguchi | 400/621 |
| 2011/0182647 | A1 * | 7/2011 | Kawaguchi | 400/642 |
| 2012/0057918 | A1 * | 3/2012 | Eoka | 400/621 |

FOREIGN PATENT DOCUMENTS

| | | |
|---|---|---|
| JP | 7290778 | 7/1995 |

* cited by examiner

*Primary Examiner* — Julian Huffman
*Assistant Examiner* — Jeremy DeLozier
(74) *Attorney, Agent, or Firm* — Adams & Wilks

(57) ABSTRACT

A printer includes a platen unit having a platen roller for advancing recording paper and a head unit detachably combined with the platen unit and having a thermal head with heating elements. A fixed blade is provided in the platen unit and a movable blade is provided in the head unit for undergoing sliding movement relative to the fixed blade to cut the recording paper. A detected member provided to the platen unit is positioned at a predetermined position of the head unit when the head unit is combined with the platen unit. The detected member engages the movable blade for movement therewith as the movable blade slides. A sensor is provided at the predetermined position of the head unit for detecting the detected member to detect that the movable blade is at an initial position and to detect a combined state between the head unit and the platen unit.

20 Claims, 9 Drawing Sheets

PRINTER WITH A CUTTER

BACKGROUND OF THE INVENTION

1. Field of the Invention

The present invention relates to a printer with a cutter.

2. Description of the Related Art

As printer with a cutter having a cutter mechanism, there has been known a thermal printer, which prints onto special recording paper (heat-sensitive paper) which develops a color when subjected to heat. A thermal printer, which is capable of being reduced in size and weight and has a simple configuration without using toner or ink, is incorporated into a casing of, for example, a cash register or a mobile terminal device and is widely used for printing various kinds of labels, register receipt, ticket, and the like.

As the above thermal printer, for example, a so-called separate-type thermal printer is known in which a head unit having a thermal head is attached to a casing body accommodating a roll paper and a platen unit having a platen roller is attached to a printer cover connected to the casing body such that the cover can be opened and closed. The above cutter mechanism includes a fixed blade and a movable blade which are incorporated respectively into, for example, the head unit and the platen unit of the above units. According to the configuration, by sliding the movable blade against the fixed blade as the platen unit is combined with the head unit, recording paper is caught between the movable and the fixed blades to be cut therebetween.

The thermal printer also has a sensor mounted therein for activating the platen roller. As a printer of this type, for example, one is known in which a sensor detects whether a cutter unit equipped with a cutter mechanism is normally set to a body unit equipped with a thermal head and a platen roller, and the platen roller is activated only when the sensor has detected that the cutter unit is normally set.

The above thermal printer, however, usually needs a sensor for detecting a position of the movable blade, for example, in terms of safety. In the configuration of the printer, therefore, separate sensors are needed including the above sensor for activating the platen roller and a sensor for detecting an initial position (home position) of the movable blade. The separate-type thermal printer also needs separate sensors including a sensor for keeping track of the setting state of the platen unit and the head unit for activating the platen roller and a sensor for detecting the initial position of the movable blade. In those cases, undesirably, the provision of the plurality of sensors easily leads to the increased number of components, decreased layout performance, and increased cost.

Here, it is conceivable that, in the above separate-type thermal printer, the head unit may be provided with the sensor and the platen unit be provided with the movable blade and the detected member working together with the movable blade. In this case, it is thought that the only one sensor is needed both for keeping track of the setting state of the units and for detecting the initial position of the movable blade by configuring the sensor to detect the detected member when the platen unit is combined with the head unit.

However, in the above separate-type thermal printer, the movable blade is attached to the platen unit, and thus this limits the simplification in the configuration of the platen unit. In a typical separate-type (clam shell type) thermal printer, the platen unit is attached to the printer cover as described above, which requires the platen unit to be reduced in size and weight. In the above platen unit, however, there is still room for reduction in size and weight of the printer cover to which the platen unit is attached.

In view of the foregoing, in this technical field, a printer with a cutter has been desired which keeps track of the setting state of the platen roller and detects an initial position of the movable blade while achieving improved layout performance, simplification, and cost reduction.

SUMMARY OF THE INVENTION

A printer according to an aspect of the present invention comprises: a platen unit having a platen roller for advancing recording paper; a head unit having a thermal head with a plurality of heating elements provided thereto, the head unit being detachably combined with the platen unit; a fixed blade incorporated in the platen unit;

a movable blade slidably incorporated in the head unit, the movable blade cutting the recording paper between the movable blade and the fixed blade; a detected member provided to the platen unit, the detected member being positioned at a predetermined position of the head unit when the head unit is combined with the platen unit, and engaging the movable blade to move therewith as the movable blade slides; and a sensor provided at the predetermined position of the head unit, the sensor detecting the detected member to detect that the movable blade is at an initial position.

According to the configuration, the detected member is provided to the platen unit, and thus, the detected member is aligned at the predetermined position of the head unit when the units are combined with each other. On the other hand, because the sensor is provided at the predetermined position of the head unit, the sensor detects the detected member when the units are reliably combined with each other. As a result, it is possible to correctly know that the units have been reliably set to each other and that the printer is ready for printing. The printer, therefore, can start printing while preventing, for example, paper jam. Also, at the same time, the sensor detects that the movable blade is at the initial position by detecting the detected member. In this way, only one sensor is used both for keeping track of the combining state of the units (setting state of the platen roller) and for detecting the position of the movable blade. Accordingly, compared with a case where different sensors are used for keeping track of the setting state of the platen roller and for detecting the position of the movable blade, the number of components can be reduced, allowing easy cost reduction. Moreover, because the number of components can be reduced, the layout performance can be improved.

In particular, according to the configuration of the printer in accordance with an aspect of the present invention, the fixed blade and the detected member is provided to the platen unit and the movable blade of the head unit engages the detected member as the movable blade slides. As a result, it is not necessary to provide the platen unit with, for example, a drive mechanism of the movable blade, which is often complex in configuration, so that the platen unit can be simplified. In this case, it is possible to reduce the size and weight of the printer cover to which the platen unit is attached.

In addition, according to the printer in accordance with an aspect of the present invention, the detected member may be able to slide together with the movable blade. According to the configuration, because the detected member can slide together with the movable blade, the detected member can be moved smoothly.

Moreover, according to the printer in accordance with an aspect of the present invention, the detected member may be rotatably supported by the platen unit and rotate with the sliding movement of the movable blade. According to this configuration, because the detected member rotates with the sliding movement of the movable blade, the detected member can be smoothly moved while achieving improved layout performance.

Further, according to the printer in accordance with an aspect of the present invention, the detected member may be arranged coaxially with the platen roller and also be rotatable independently from the platen roller as the movable blade slides. According to the configuration, because the detected member can be provided on a platen shaft of the platen roller, as compared with the case where a supporting member for the detected member is additionally provided, the number of components can be reduced, allowing easy cost reduction.

Furthermore, according to the printer in accordance with an aspect of the present invention, the platen unit may be provided with a biasing member biasing the detected member toward the predetermined position. According to the configuration, because the detected member is biased toward the predetermined position by the biasing member, the detected member can be smoothly returned toward the predetermined position following the movable blade returning to the initial position. This can improve the operational reliability of the sensor.

As described above, according to the printer in accordance with an aspect of the present invention, it is possible to keep track of the setting state of the platen roller and to detect an initial position of the movable blade while achieving improved layout performance, simplification, and cost reduction.

DETAILED DESCRIPTION OF THE PREFERRED EMBODIMENTS

Next, embodiments of the present invention will be described based on the drawings.

First Embodiment

Figure 1:
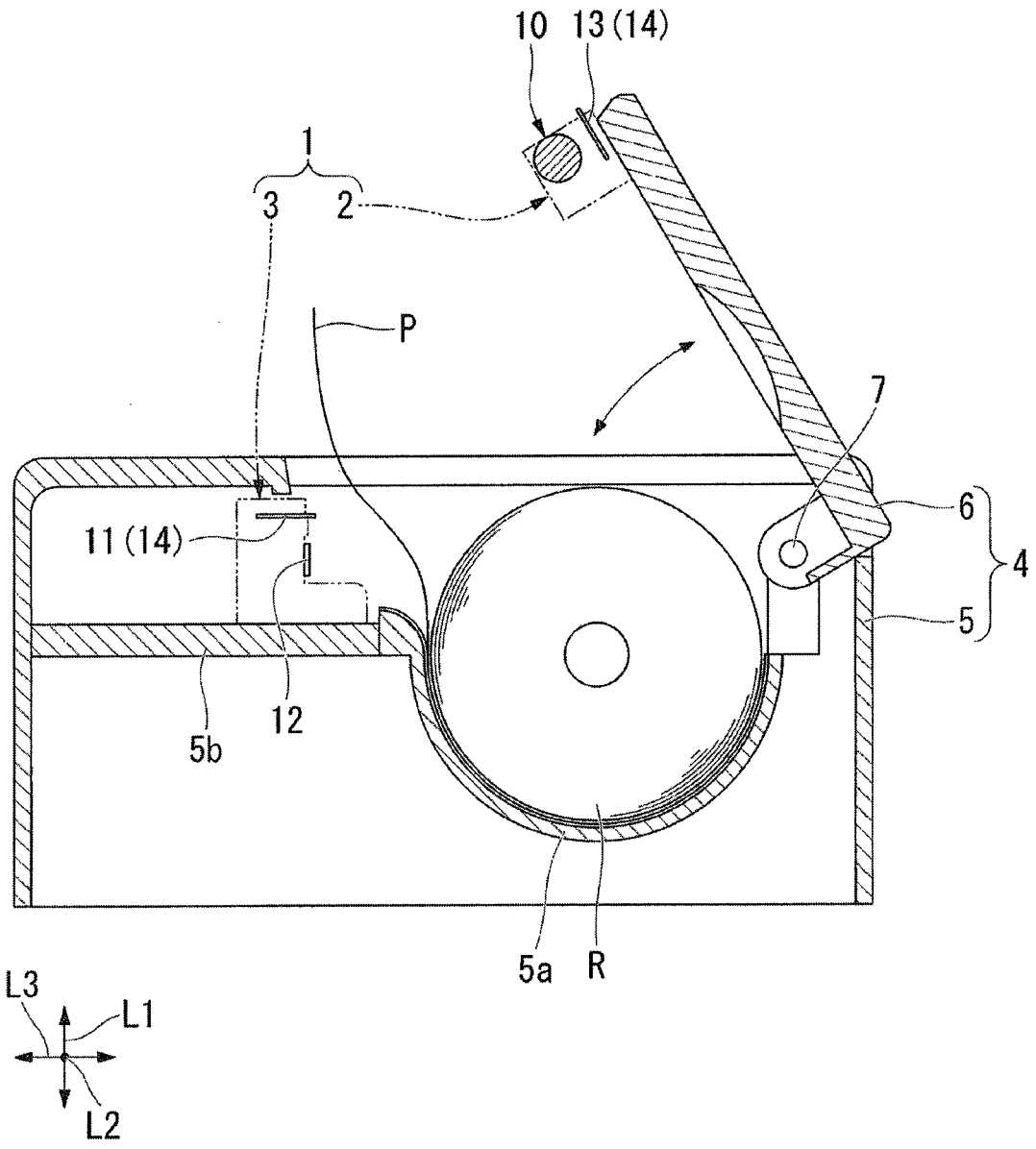
FIG. 1 is a cross-sectional view showing a thermal printer incorporated in a casing, with a printer cover being at an open position.
Figure 2:
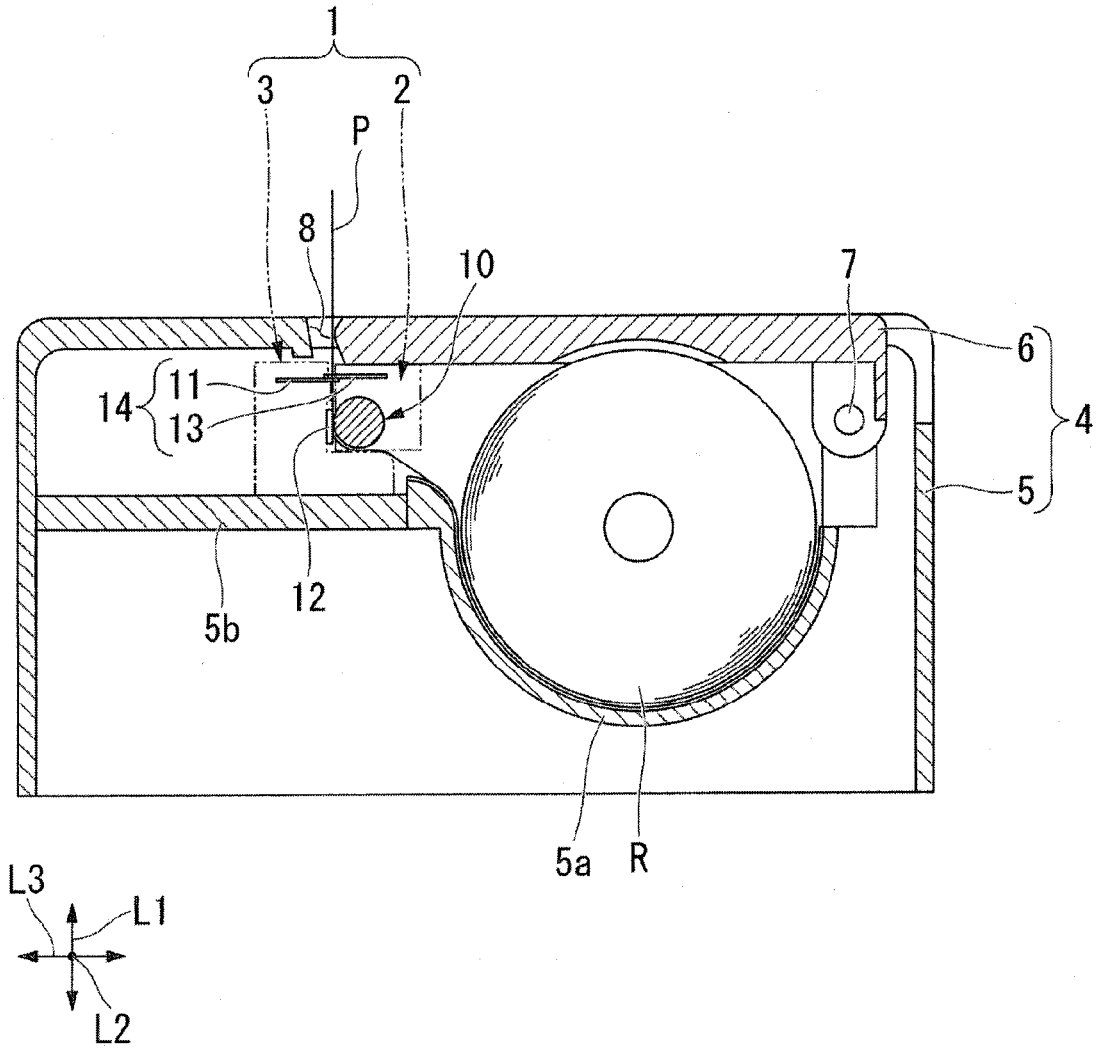
FIG. 2 is a cross-sectional view showing the thermal printer incorporated in the casing, with the printer cover being at a closed position.

FIGS. 1 and 2 are cross-sectional views showing a thermal printer 1 incorporated in a casing 4, where FIG. 1 shows an open position of a printer cover 6 and FIG. 2 shows a closed position of the cover 6. In the embodiment, the explanation will be given with, in an example shown in FIG. 1, an up-down direction on the sheet simply as an up-down direction L1, a direction perpendicular to the sheet as a left-right direction L2, and a direction perpendicular both to the up-down direction L1 and the left-right direction L2 as a front-rear direction L3. As shown in FIGS. 1 and 2, the thermal printer 1 of the embodiment comprises a platen unit 2 and a head unit 3 which are detachably combined with each other and is incorporated in the casing 4 of a so-called clam shell type accommodating a roll paper R of wound recording paper P.

The casing 4 includes a casing body 5 having a roll paper accommodating part 5*a* formed therein accommodating the roll paper R and a printer cover 6 opening and closing the roll paper accommodating part 5*a*. The printer cover 6 is rotatably coupled to the casing body 5 through a hinge part 7. Also, as shown in FIG. 2, at the closed position of the printer cover 6, a discharging port 8 for discharging the recording paper P to the outside (upward) is formed between an opening edge of the roll paper accommodating part 5*a* and a front end part of the printer cover 6.

The above platen unit 2 mainly incorporates a platen roller 10 and a fixed blade 13 and is assembled to the front end side of the inner surface of the printer cover 6. Accordingly, the platen unit 2 is detachably combined with the head unit 3 as the unit 2 moves with the opening or closing operation of the printer cover 6. On the other hand, the head unit 3 mainly incorporates, for example, a thermal head 12 and a movable blade 11 and is assembled to the casing body 5. In the illustrated example, the head unit 3 is fixed on an inner plate 5*b* provided adjacent to the roll paper accommodating part 5*a* with the thermal head 12 facing the accommodating part 5*a* side.

In this connection, when the printer cover 6 is closed to combine the platen unit 2 with the head unit 3 as shown in FIG. 2, the thermal head 12 is pressed against the platen roller 10, and also, the movable blade 11 overlaps the fixed blade 13. Incidentally, the fixed blade 13 and the movable blade 11 constitute a cutter mechanism 14.

Figure 3:
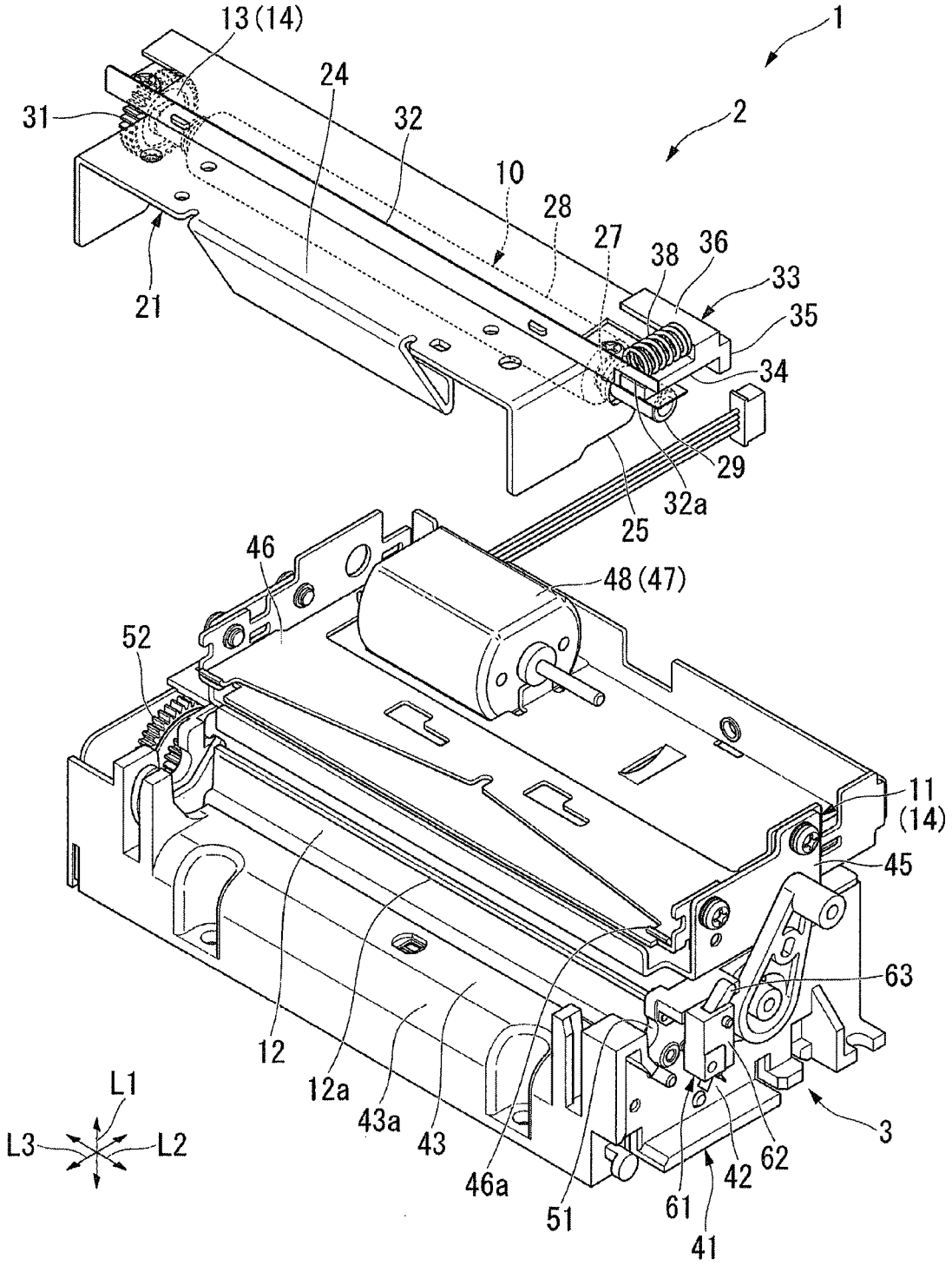
FIG. 3 is an exploded perspective view of the thermal printer in a first embodiment.
Figure 4:
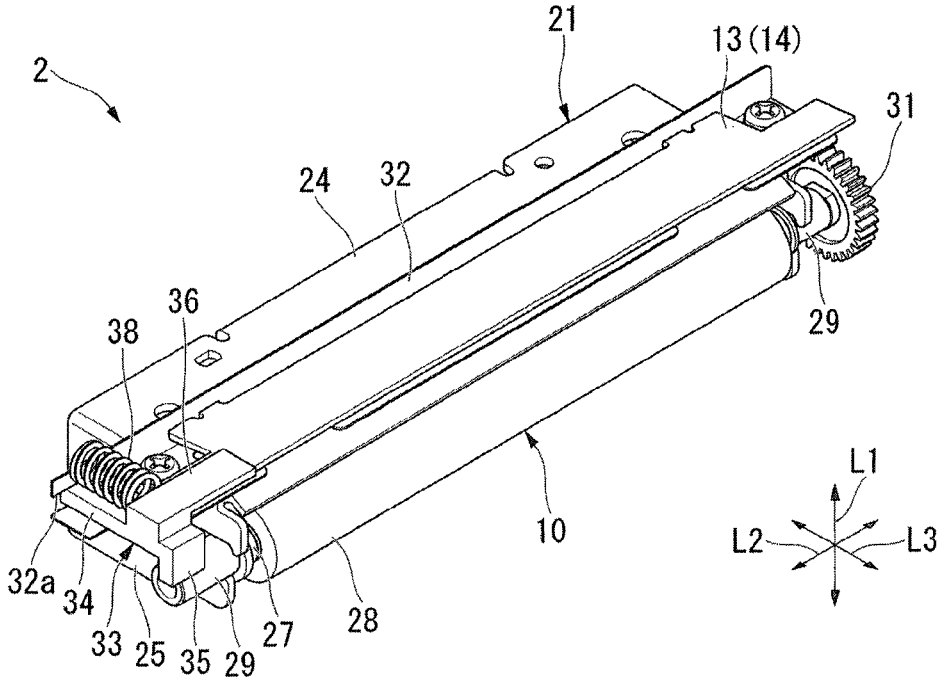
FIG. 4 is a perspective view of a platen unit in the first embodiment.

Next, the configuration of the above thermal printer 1 will be described in detail. FIG. 3 is an exploded perspective view of the thermal printer 1. FIG. 4 is a perspective view of the platen unit 2. As shown in FIGS. 3 and 4, the platen unit 2 includes a platen frame 21 and the platen roller 10 and the fixed blade 13 which are supported by the platen frame 21. The platen frame 21 includes a base 24 extended along the left-right direction L2 and a pair of side walls 25 extending downward from both end parts of the base 24 in the left-right direction L2.

The platen roller 10 is arranged such that, when the platen unit 2 is combined with the head unit 3 at the closed position of the printer cover 6, an outer circumferential surface of the platen roller 10 contacts the thermal head 12 of the head unit 3 with the recording paper P caught therebetween. Specifically, the platen roller 10 includes a platen shaft 27 extending along the left-right direction L2 and a roller body 28 which is made of, for example, rubber and is externally fitted onto the platen shaft 27.

The both end parts of the platen shaft 27 are provided with bearings 29, through which the platen roller 10 is rotatably supported by the side wall 25. A gear 31 for the platen is mounted onto one end part of the platen shaft 27 (a portion of the platen shaft 27 positioned outwardly beyond the bearing 29 on one side in the left-right direction L2). The platen gear 31 meshes with a platen-driving gear 52 (refer to FIG. 3), to be described later, of the head unit 3 when the platen unit 2 is combined with the head unit 3, and receives a rotational force. This enables the entire platen roller 10 to rotate and the recording paper P to advance while being caught between the platen roller 10 and the thermal head 12.

The fixed blade 13 is formed in a plate-like shape extended along the left-right direction L2 and is fixed on the base 24 of the platen frame 21 with its cutting edge facing one side in the front-rear direction L3. The root of the fixed blade 13 is held by an erected part 32 erected upward from the base 24 of the platen frame 21.

Figure 5:
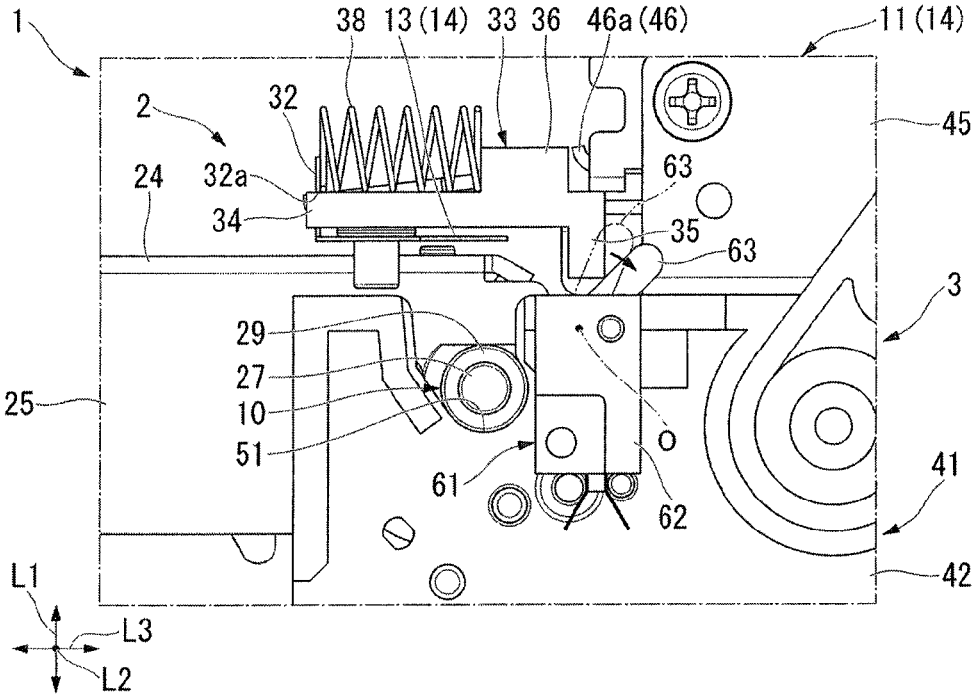
FIG. 5 is a side view of the thermal printer in the first embodiment viewed from another side in a left-right direction.
Figure 6:
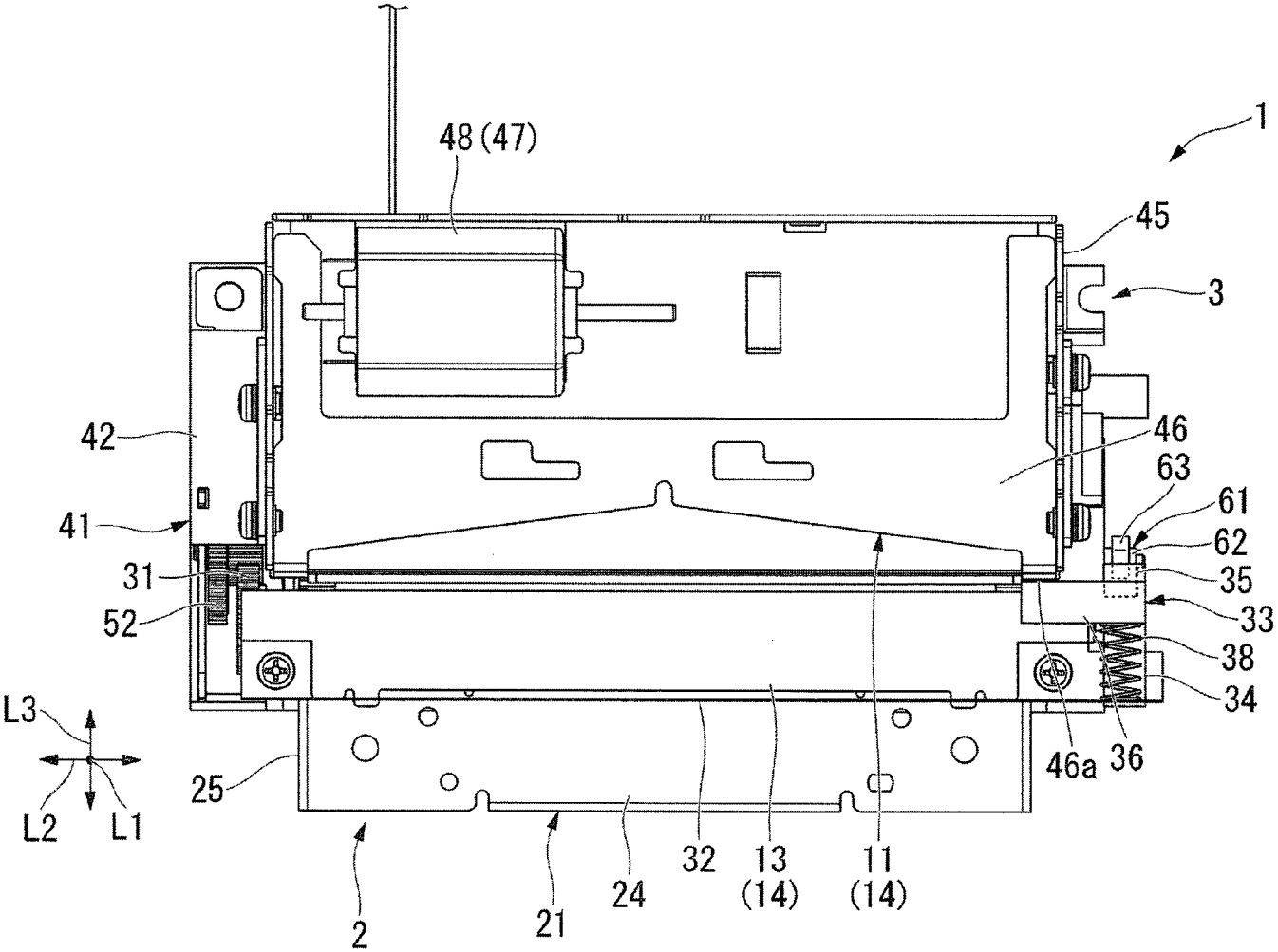
FIG. 6 is a plan view of the thermal printer in the first embodiment.

FIG. 5 is a side view of the thermal printer 1 viewed from the other side in the left-right direction L2. FIG. 6 is a plan view of the thermal printer 1. Here, as shown in FIGS. 4 to 6, a detected member 33 slidable in the front-rear direction L3 relative to the platen frame 21 is provided at a portion of the frame 21 positioned on the other side in the left-right direction L2. The detected member 33 is formed in an L-shape as viewed from each of the left-right direction L2 and the up-down direction L1. Specifically, the detected member 33 includes a base piece 34 extending along the front-rear direction L3, a first protruding piece 35 extending downward from an end part of the base piece 34, and a second protruding piece 36 extending from the end part of the base piece 34 toward the one side in the left-right direction L2.

The base piece 34 is supported by a portion of the base 24 of the platen frame 21 positioned outwardly beyond the side wall 25 on the other side in the left-right direction L2, and its front end part is positioned on the one side in the front-rear direction L3 relative to the cutting edge of the fixed blade 13. Note that, a notch 32*a* for allowing the sliding movement of the base piece 34 is formed at a portion of the above erected part 32 of the platen frame 21 where the erected part 32 overlaps the base piece 34 in the front-rear direction L3.

The first protruding piece 35 is for operating a sensor 61 to be described later to be turned on and off with its lower end part positioned lower than the fixed blade 13. The leading end part of the second protruding piece 36 is positioned above the fixed blade 13 and the second protruding piece 36 is aligned at a position (predetermined position) where the protruding piece 36 is opposed to the movable blade 11 in the front-rear direction L3 when the platen unit 2 is combined with the head unit 3. Also, a biasing member 38 biasing the detected member 33 in the direction (toward the cutting edge of the fixed blade 13) away from the erected part 32 is interposed between a base end part of the second protruding piece 36 and the erected part 32.

As shown in FIG. 3, the foregoing head unit 3 includes a unit frame 41, the thermal head 12 supported by the unit frame 41, and the movable blade 11. The unit frame 41 is made, for example, of rubber and formed in a box shape. The unit frame 41 includes a pair of side walls 42 provided on both sides in the left-right direction L2, and a base 43 spanning between the side walls 42.

The movable blade 11 is provided at a position where the blade 11 faces the fixed blade 13 in the front-rear direction L3 across the recording paper P when the printer cover 6 is closed and the head unit 3 is combined with the platen unit 2. Specifically, the movable blade 11 includes a movable blade frame 45, a movable blade body 46 slidably supported by the movable blade frame 45, and a drive mechanism 47 for driving the movable blade body 46.

The movable blade frame 45 is placed on a portion of the base 43 at the one side in the front-rear direction L3 such that the frame 45 spans between side walls 42. The movable blade body 46 is formed in an approximately V-shape when viewed in a plan view with the length from the root to the cutting edge gradually reduced toward the middle.

In this connection, at both end parts of the movable blade body 46 in the left-right direction L2 is formed a pair of protrusions 46*a* curving upward as it extends toward the other side in the front-rear direction L3. These protrusions 46*a* function as a guide making it easier for the movable blade 11 to override the fixed blade 13 when the movable blade 11 slides against the fixed blade 13. As shown in FIGS. 5 and 6, the protrusion 46*a* is formed on a position where the protrusion 46*a* is opposed to the second protruding piece 36, of the foregoing detected member 33, in the front-rear direction L3. This allows the protrusion 46*a*, when the movable blade 11 slides against the fixed blade 13, to bump into the second protruding piece 36 to press the detected member 33 toward the other side in the front-rear direction L3.

The drive mechanism 47 includes a reversible motor 48 for cutter mounted on the movable blade frame 45 and a not-shown train wheel mechanism connected between the reversible cutter motor 48 and the movable blade body 46. The movable blade body 46 slides as a driving force of the cutter motor 48 is transferred to the blade body 46 through the train wheel mechanism.

As shown in FIG. 3, the thermal head 12 is formed in a plate shape extended along the left-right direction L2 (the direction along the width of the recording paper P) and placed on a portion of the base 43 at the other side in the front-rear direction L3 relative to the movable blade 11. A plurality of heating elements 12*a* is arranged in a line on the surface of the thermal head 12 and positioned opposed to the platen roller 10 at the closed position of the printer cover 6. Note that, the thermal head 12 is biased toward the other side in the front-rear direction L3 (toward the platen roller 10 side) by, for example, a not-shown coil spring.

A guiding part 43*a* is formed on a portion of the base 43 of the unit frame 41 on the other side in the front-rear direction L3 relative to the thermal head 12. The guiding part 43*a* is positioned lower than the above heating elements 12*a* and guides the recording paper P drawn out of the roll paper accommodating part 5*a* to the thermal head 12.

Bearing accommodating parts 51 receiving bearings 29 of the platen roller 10 are formed on portions of the side walls 42 of the unit frame 41 corresponding to the both sides of the guiding part 43*a* in the left-right direction L2. Accordingly, when the platen unit 2 is combined with the head unit 3, the platen roller 10 and the thermal head 12 are joined to each other without getting misaligned from each other, so that the recording paper P is reliably caught therebetween.

On the one side in the left-right direction L2 of the unit frame 41 is provided the platen-driving gear 52 meshing with the platen gear 31 of the platen unit 2 when the platen unit 2 is combined with the head unit 3. The platen-driving gear 52 is connected to a not-shown platen driving motor provided inside the unit frame 41 through a not-shown train wheel mechanism for platen. Accordingly, by appropriately rotating the platen driving motor, the rotational force can be transferred through the platen train wheel mechanism and the platen-driving gear 52 to the platen gear 31 so as to rotate the platen roller 10.

Here, as shown in FIG. 5, the sensor 61 detecting the detected member 33 of the platen unit 2 is provided on the side wall 42, of the unit frame 41, on the other side in the left-right direction L2. The sensor 61 is a so-called mechanical sensor which detects the detected member 33 (the first protruding piece 35) by, for example, a mechanical system. Specifically, the sensor 61 includes a body 62 attached on the outer surface of the side wall 42 and a lever 63 rotatable relative to the body 62 about an axial center O running along the left-right direction L2.

The lever 63 moves in a tilting manner between a standing position to turn the sensor 61 off (refer to FIG. 8) and a tilting position to turn the sensor 61 on (refer to FIG. 5). The lever 63 is biased toward the standing position by a not-shown biasing member.

The sensor 61 is fixed on the side wall 42 such that, in the standing position, the lever 63 projects above the side wall 42 and is held as tilted toward the one side in the front-rear direction L3 as it extends upward. Specifically, the sensor 61 is placed at a position (a predetermined position) which is on a path of the first protruding piece 35 in opening and closing operation of the printer cover 6 and at which, when the head unit 3 is combined with the platen unit 2, the lever 63 engages the above first protruding piece 35 from below to be forced toward the tilting position.

Next, the operation of the above thermal printer 1 will be described. As shown in FIGS. 1 and 3, when the printer cover 6 is closed after dropping the roll paper R in the roll paper accommodating part 5*a*, the bearings 29 of the platen roller 10 are accommodated in the bearing accommodating parts 51 of the head unit 3. Thus, as shown in FIG. 2, the platen unit 2 is fit onto the head unit 3, combining the units 2 and 3 with each other.

At this time, the movable blade 11 overlaps the fixed blade 13 with an appropriate contact pressure and the recording paper P gets caught between the platen roller 10 and the thermal head 12. After passing through a space between the movable blade 11 and the fixed blade 13, the recording paper P in turn gets drawn from the discharging port 8 to the outside of the casing 4. Besides, as shown in FIG. 3, the platen gear 31 of the platen unit 2 meshes with the platen-driving gear 52 of the head unit 3.

Then, the platen driving motor is driven to transfer the rotational force to the platen gear 31 of the platen unit 2. This rotates the platen roller 10, so that the recording paper P is advanced while being caught between the roller 10 and the thermal head 12. By appropriately heating the heating elements 12*a* of the thermal head 12 concurrently with the paper advancement, various characters, figures, and the like can be clearly printed onto the recording paper P being advanced.

The printed recording paper P passes through the space between the fixed blade 13 and the movable blade 11. Then, after the recording paper P passing through by a predetermined length, the cutter motor 48 is driven, thereby sliding the movable blade body 46 toward the fixed blade 13. Thus, the recording paper P is cut between the fixed blade 13 and the movable blade 11. As a result, the cut recording paper P can be used as a register receipt, a ticket, and the like.

By the way, as shown in FIG. 5, in the process of combining the units 2 and 3 with each other (in the closing operation of the printer cover 6), the detected member 33 is aligned at the above predetermined position of the head unit 3. Specifically, as the printer cover 6 is closed, the first protruding piece 35 of the detected member 33 provided to the platen unit 2 contacts (engages) the lever 63 of the sensor 61 provided to the head unit 3 from above. When the printer cover 6 is further rotated toward the closed position, the first protruding piece 35 presses the lever 63 downward. Thus, the lever 63 rotates about the axial center O from the standing position toward a detected position (refer to an arrow in FIG. 5).

Then, when the units 2 and 3 are combined with each other (when the printer cover 6 is brought to the closed position), the lever 63 reaches the detected position, turning the sensor 61 on. This allows the sensor 61 to detect the detected member 33, which makes it possible to know that the units 2 and 3 have been normally combined with each other. In other words, it is possible to correctly know that the platen roller 10 has been reliably set and that the printer 1 is ready for printing with the thermal head 12 pressed against the platen roller 10. The printer, therefore, can start printing while preventing, for example, paper jam.

In the closing operation of the printer cover 6, if the movable blade 11 is away from the home position (for example, if the movable blade body 46 projects to the other side in the front-rear direction L3), the second protruding piece 36 and the protrusion 46*a* of the movable blade body 46 interfere with each other in the up-down direction L1, so that the printer cover 6 does not reach the closed position. That is, by detecting the detected member 33 as described above, the sensor 61 detects that the movable blade 11 is at the home position. Specifically, if the movable blade 11 is at the home position, when the units 2 and 3 are combined with each other, the protrusion 46*a* of the movable blade body 46 and the second protruding piece 36 of the detected member 33 are opposed to each other in the front-rear direction L3.

Figure 7:
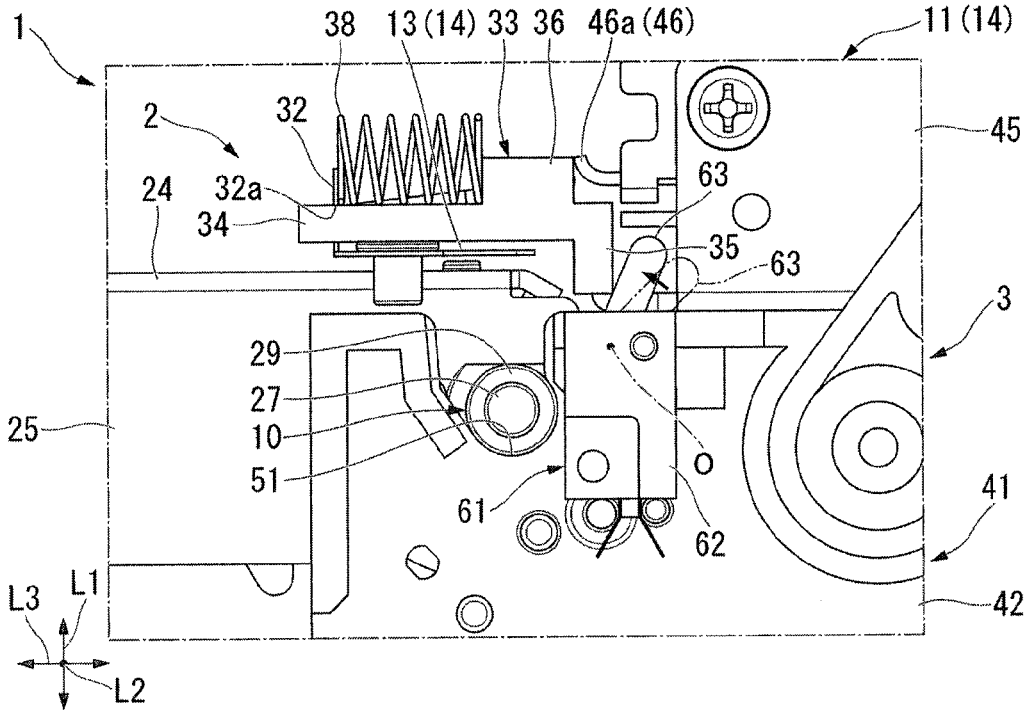
FIG. 7 is a side view corresponding to FIG. 5, describing the operation of the printer during sliding movement of a movable blade body.
Figure 8:
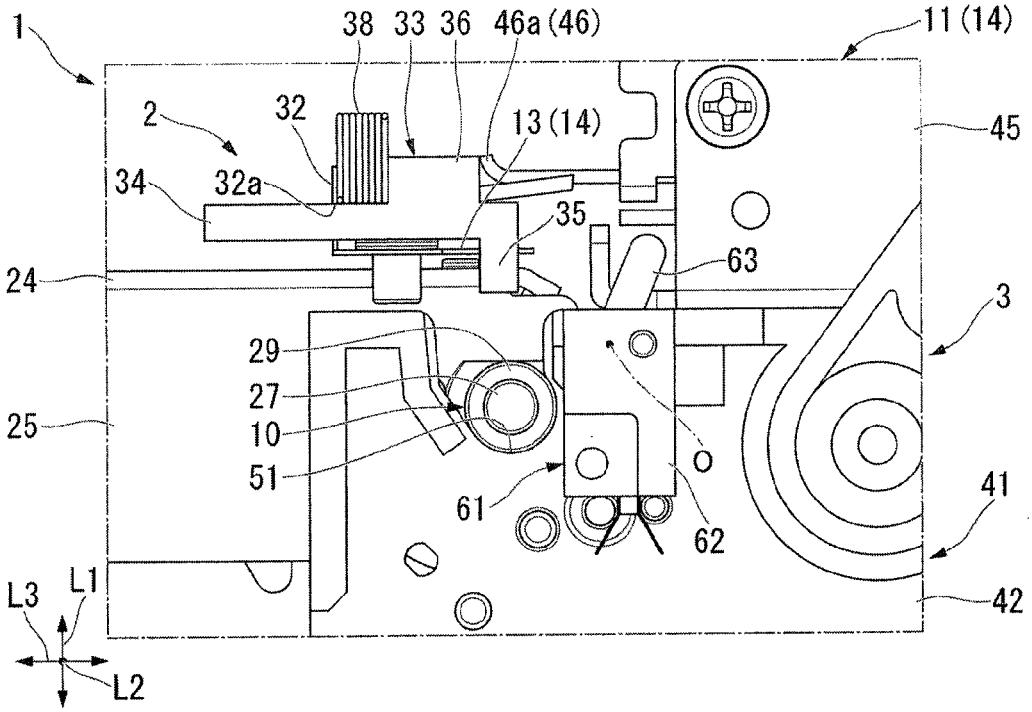
FIG. 8 is a side view corresponding to FIG. 5, describing the operation of the printer during the sliding movement of the movable blade body.
Figure 9:
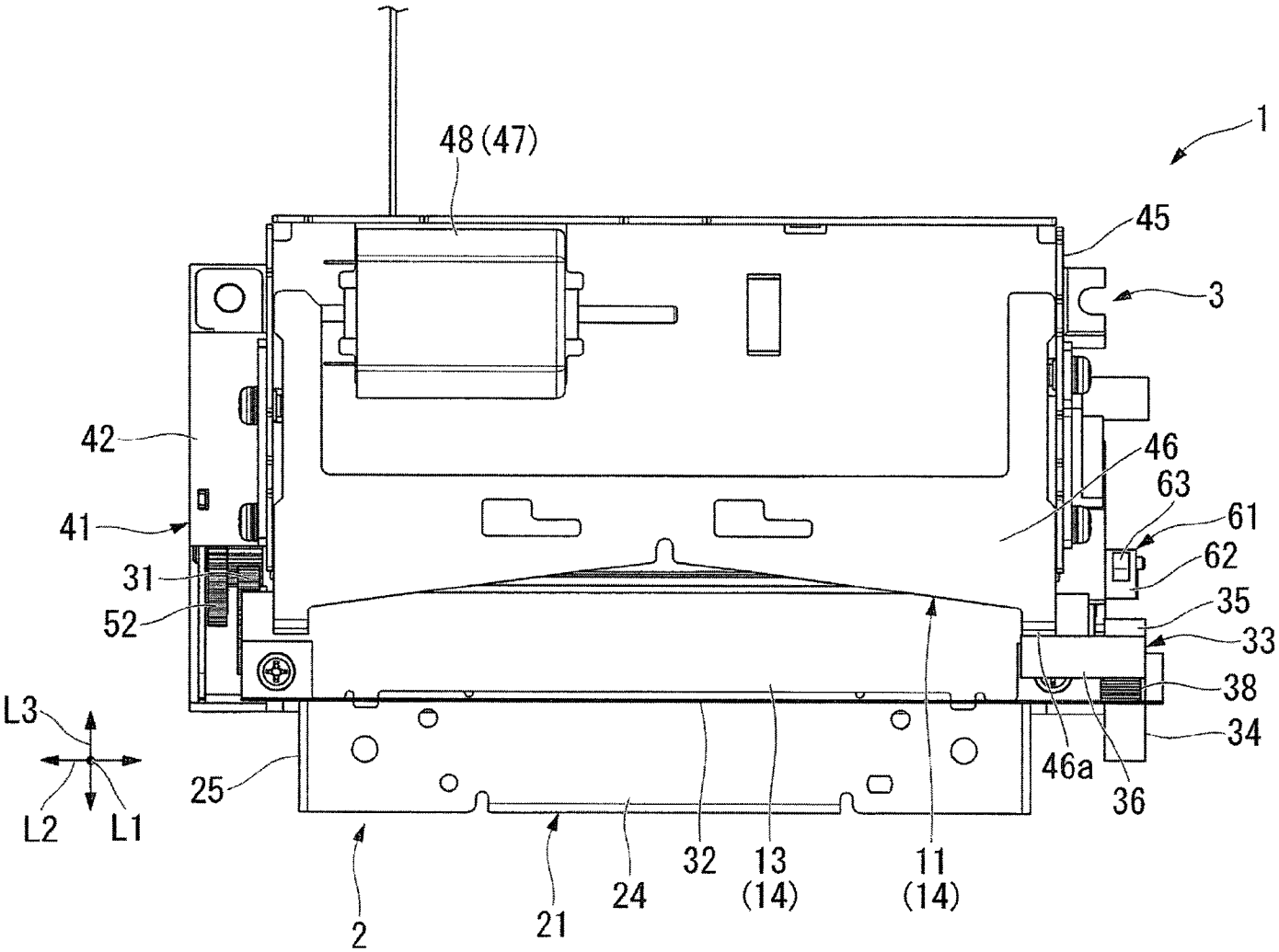
FIG. 9 is a plan view corresponding to FIG. 6, describing the operation of the printer during the sliding movement of the movable blade body.

FIGS. 7 to 9 describe the operation of the printer during the sliding movement of the movable blade body 46. FIGS. 7 and 8 are side views corresponding to FIG. 5, and FIG. 9 is a plan view corresponding to FIG. 6. Here, as shown in FIGS. 7 to 9, in printing, when the movable blade body 46 is slid toward the fixed blade 13 for cutting the recording paper P with the cutter mechanism 14, the protrusion 46*a* of the movable blade body 46 bumps into (engages) the second protruding piece 36 of the detected member 33 from the one side in the front-rear direction L3. This slides the detected member 33 toward the other side in the front-rear direction L3 (into the direction against the biasing force of the biasing member 38), as the movable blade body 46 slides, with the second protruding piece 36 engaging with the protrusion 46*a* of the movable blade body 46.

At this time, the first protruding piece 35 releases the pressing of the lever 63 as the detected member 33 slides, and thus this rotates the lever 63 about the axial center O toward the standing position (refer to an arrow in FIG. 7). Then, as the lever 63 returns to the standing position, the sensor 61 is turned off, so that the detected member 33 is not detected. That is, if the sensor 61 is turned off with the units 2 and 3 being combined with each other, it is determined that the movable blade body 46 is away from the home position.

Then, as the cutter motor 48 reverses after the recording paper P is cut, the movable blade body 46 slides in the direction away from the fixed blade 13 (to the one side in the front-rear direction L3). As a result, the detected member 33 engaging the movable blade body 46 slides with the same toward the one side in the front-rear direction L3 by the restoring force of the biasing member 38. Then, the first protruding piece 35 of the detected member 33 bumps into the lever 63 and again presses it toward the detected position. And then, as the movable blade body 46 returns to the home position, the detected member 33 rotates the lever 63 to the detected position, so that the sensor 61 detects the detected member 33. In this way, the state detected by the sensor 61 changes as the movable blade body 46 slides, causing a change in detection signal. Thus, by storing the change in the detection signal (such as switching time between the on and the off states in the cutting cycle) in advance, it is possible to know whether or not the movable blade body 46 is properly moving, thereby significantly improving the operational reliability.

Thus, accordingly to the embodiment, when the units 2 and 3 are combined with each other at the closed position of the printer cover 6, the sensor 61 detects the detected member 33, so that it is possible by that detection to know that the units 2 and 3 have been normally combined with each other. Further, because the sensor 61 detects the detected member 33, it is possible to know that the movable blade body 46 is at the home position. That is, the only one sensor 61 is used both for keeping track of the setting state of the platen roller 10 and for detecting the position of the movable blade body 46. Accordingly, compared with a case where different sensors are used for keeping track of the setting state of the platen roller 10 and for detecting the position of the movable blade body 46, the number of components can be reduced, allowing easy cost reduction. Moreover, because the number of components can be reduced, the layout performance can be improved.

In particular, in the embodiment, the fixed blade 13 and the detected member 33 are provided to the platen unit 2 attached to the printer cover 6, and, when the units 2 and 3 are combined with each other, the movable blade body 46 and the detected member 33 engage with each other as the movable blade body 46 slides. According to the configuration, it is not necessary to provide the platen unit 2 with, for example, a drive mechanism of the movable blade 11, which is often complex in configuration, so that the platen unit 2 can be simplified. In this case, it is possible to reduce the size and weight of the printer cover 6 to which the platen unit 2 is attached. Therefore, it is possible to keep track of the setting state of the platen roller 10 and detect the home position of the movable blade 11 while achieving improved layout performance, simplification, and cost reduction.

In addition, in the embodiment, the detected member 33 can slide together with the movable blade body 46, so that the detected member 33 can be moved smoothly. Further, the detected member 33 is biased toward the movable blade body 46 by the biasing member 38, so that the detected member 33 can be smoothly returned toward the initial position following the movable blade body 46 returning to the home position. This can improve the operational reliability of the sensor 61. Moreover, further simplification can be achieved compared with a case where, when the units 2 and 3 are combined with each other, the detected member 33 and the movable blade body 46 directly engage with each other, for example.

Second Embodiment

Figure 10:
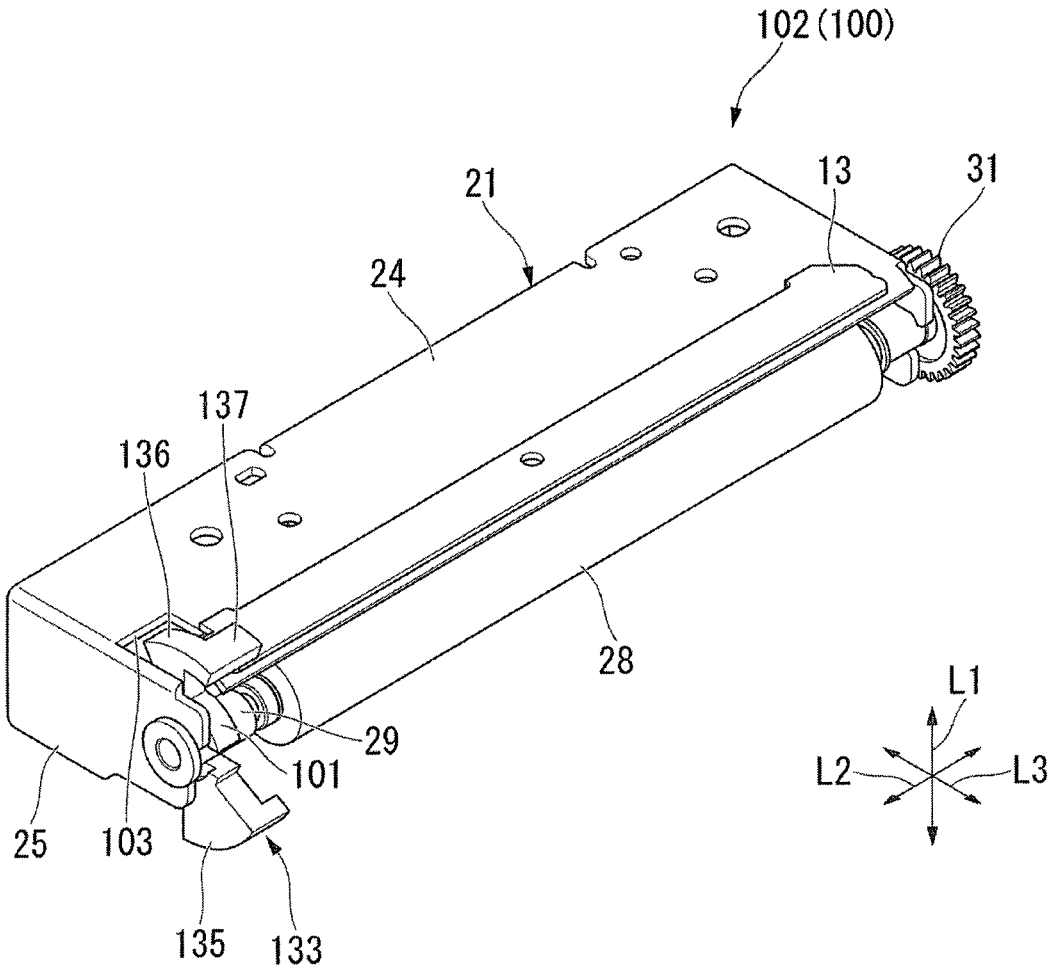
FIG. 10 is a perspective view of a platen unit in a second embodiment.
Figure 11:
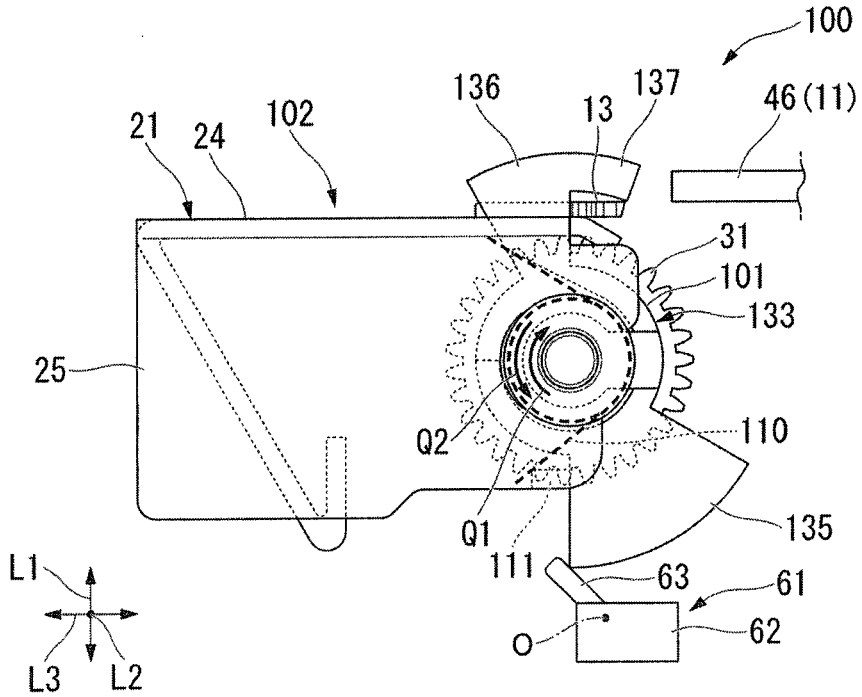
FIG. 11 is a side view of the platen unit in the second embodiment.

Next, a second embodiment of the present invention will be described. The present embodiment is different from the first embodiment in that a detected member 133 is rotatable. In the description below, the configurations similar to those in the above first embodiment will be given the same reference characters to omit the description thereof. FIG. 10 is a perspective view of a platen unit 102 in the second embodiment, and FIG. 11 is a side view of the platen unit 102. As shown in FIGS. 10 and 11, in a thermal printer 100 of the embodiment, the detected member 133 of the platen unit 102 is arranged coaxially with the platen shaft 27 but attached such that the detected member 133 is rotatable (refer to arrows Q1 and Q2 in FIG. 11) independently from the platen shaft 27. Specifically, the detected member 133 includes an annular outer attaching body 101 outwardly attached to the bearing 29 positioned on the other side in the left-right direction L2 of the platen shaft 27 and a first protruding piece 135 and a second protruding piece 136 protruding separately from each other from the outer attaching body 101 radially outwardly.

The first protruding piece 135 is for turning the sensor 61 on and off and is formed in a fan shape widened in the downward direction when viewed in a side view from the left-right direction L2. The first protruding piece 135 is configured to engage the lever 63 of the sensor 61 from above and force the lever 63 toward the tilting position when the head unit 3 and the platen unit 102 are combined with each other.

The second protruding piece 136 is formed in a fan shape widened in the upward direction when viewed in a side view from the left-right direction L2 and has its upper end part positioned upper than the fixed blade 13. The second protruding piece 136 has on the edge at the one side in the front-rear direction L3 an engaging part 137 extending toward the one side in the left-right direction L2. The engaging part 137 is positioned above the fixed blade 13 and, when the platen unit 102 and the head unit 3 are combined with each other, is opposed to the movable blade body 46 in the front-rear direction L3. Parenthetically, a notch 103 (refer to FIG. 10) for allowing the rotating movement of the second protruding piece 136 is formed at a portion of the base 24 of the platen frame 21 overlapping the second protruding piece 136 in the rotating direction.

As shown in FIG. 11, a biasing member 110 biasing the second protruding piece 136 in the direction toward the cutting edge of the fixed blade 13 (Q1 direction) is interposed between the detected member 133 and the platen frame 21. The biasing member 110 is formed, for example, by a torsion coil spring, and outwardly attached to the bearing 29 with its one end portion engaged with the detected member 133 and with the other end portion engaged with an engaging protrusion 111 formed on the side wall 25 of the platen frame 21. Parenthetically, the above first protruding piece 135 can contact the engaging protrusion 111 so as to restrict the rotation of the detected member 133 into the Q1 direction.

In the thermal printer 100 with such a configuration, in the process of combining the units 102 and 3 with each other (in the closing operation of the printer cover 6), the first protruding piece 135 of the detected member 133 provided to the platen unit 102 contacts (engages), from above, the lever 63 of the sensor 61 provided to the head unit 3. This rotates the lever 63 about the axial center O from the standing position to the detected position.

Then, when the units 102 and 3 are combined with each other, the lever 63 reaches the detected position, turning the sensor 61 on. This allows the sensor 61 to detect the detected member 133, which makes it possible to know that the units 102 and 3 have been normally combined with each other. That is, it is possible to know that the protrusion **46*a* of the movable blade body 46 is opposed to the second protruding piece 136 (engaging part 137) of the detected member 133 in the front-rear direction L3 and the movable blade 11** is at the home position.

Figure 12:
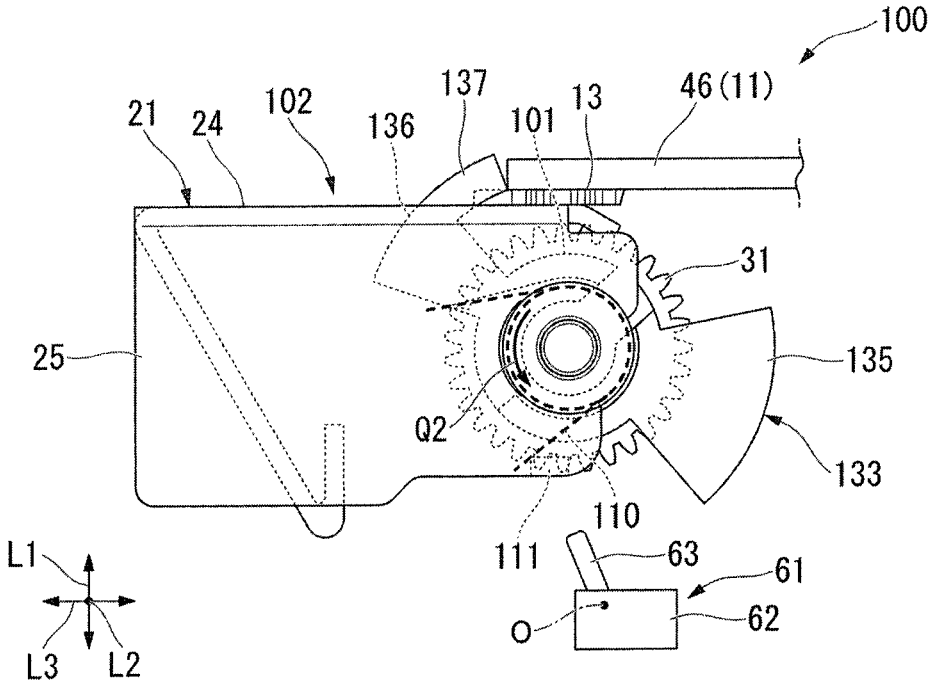
FIG. 12 is a side view of the platen unit in the second embodiment.

FIG. 12 is a side view corresponding to FIG. 11, describing the operation of the printer during the sliding movement of the movable blade body 46. Here, as shown in FIG. 12, when the movable blade body 46 is slid toward the fixed blade 13 for cutting the recording paper P with the cutter mechanism 14, the movable blade body 46 bumps into (engages) the engaging part 137 of the detected member 133 from the one side in the front-rear direction L3. This rotates the detected member 133 toward the Q2 direction, as the movable blade body 46 slides, with the engaging part 137 engaging the protrusion **46*a* of the movable blade body 46**.

At this time, the first protruding piece 135 releases the pressing of the lever 63 as the detected member 133 rotates, and thus this rotates the lever 63 about the axial center O toward the standing position. Then, as the lever 63 returns to the standing position, the sensor 61 is turned off, so that the detected member 133 is not detected. That is, if the sensor 61 is turned off with the units 102 and 3 being combined with each other, it is determined that the movable blade body 46 is away from the home position (for example, cutting position where the movable blade body 46 has overridden the fixed blade 13).

Then, as shown in FIG. 11, as the cutter motor 48 reverses after the recording paper P is cut, the movable blade body 46 slides in the direction away from the fixed blade 13 (to the one side in the front-rear direction L3). As a result, the detected member 133 engaging the movable blade body 46 rotates with the same toward the Q1 direction by the restoring force of the biasing member 110. Then, the first protruding piece 135 of the detected member 133 bumps into the lever 63 and again presses it toward the detected position. And then, as the movable blade body 46 returns to the home position, the detected member 133 rotates the lever 63 to the detected position, so that the sensor 61 detects the detected member 133.

Thus, accordingly to the embodiment, the effects similar to those in the foregoing embodiment can be obtained, and also, the layout performance can be improved because the detected member 133 is rotatable. Moreover, the detected member 133 is arranged coaxially with the platen roller 10 but is rotatable independently from the roller 10, and thus, as compared with the case where a supporting member for the detected member 133 is additionally provided, the number of components can be reduced, allowing easy cost reduction.

Note that the technical range of the present invention is not limited to the above embodiments but can variously be modified without departing from the gist of the invention.

For example, although in the forgoing embodiments, the configuration has been described in which the movable blade body 46 itself of the movable blade 11 engages the detected member for cutting the recording paper P with the cutter mechanism 14, the present invention is not limited to this. For example, the configuration may be such that, as a movable blade, a movable blade holder is provided which slides with the movable blade body 46 as well as holding the movable blade body 46 and the movable blade holder engages the detected member.

Further, although in the forgoing embodiments, the configuration has been described in which the lever 63 is provided as a mechanical sensor, the present invention is not limited to this, and a switch may be provided which is retractable in and out of the body 62. Alternatively, instead of a mechanical sensor, an optical sensor such as photo-interrupter and photo-reflector may be used.

Still further, although in the forgoing embodiment, the configuration has been described in which the biasing member is provided between the detected member and the platen frame 21 for returning the detected member toward the initial position following the movable blade body 46 returning to the home position, the present invention is not limited to this. The design can be appropriately changed as long as the detected member follows the movement of the movable blade 11. For example, the movable blade 11 may be directly engaged with the detected member when the units 102 and 3 are combined with each other.

Also, although in the forgoing second embodiment, the configuration has been described in which the detected member 133 is arranged coaxially with the platen roller 10, the present invention is not limited to this, and the detected member 133 may be rotatably supported by a member of the platen unit 102 other than the platen shaft 27.

Furthermore, the components of the above embodiments can be appropriately replaced with well-known components and the above modifications can be appropriately combined without departing from the gist of the invention.

What is claimed is:

1. A printer comprising:

a platen unit having a platen roller for advancing recording paper;

a head unit having a thermal head with a plurality of heating elements provided thereto, the head unit being detachably combined with the platen unit;

a fixed blade incorporated in the platen unit;

a movable blade slidably incorporated in the head unit for cutting the recording paper between the movable blade and the fixed blade;

a detected member provided to the platen unit, the detected member being positioned at a predetermined position of the head unit when the head unit is combined with the platen unit, and the detected member engaging the movable blade to move therewith as the movable blade slides; and a sensor provided at the predetermined position of the head unit for detecting the detected member to detect that the movable blade is at an initial position and to detect a combined state between the head unit and the platen unit.

2. A printer according to claim 1, wherein the detected member is slidable together with the movable blade.

3. A printer according to claim 1, wherein the detected member is rotatably supported by the platen unit and rotates with the sliding movement of the movable blade.

4. A printer according to claim 3, wherein the detected member is arranged coaxially with the platen roller and is rotatable independently from the platen roller as the movable blade slides.

5. A printer according to claim 1, wherein the platen unit is provided with a biasing member for biasing the detected member toward the predetermined position.

6. A printer according to claim 2, wherein the platen unit is provided with a biasing member for biasing the detected member toward the predetermined position.

7. A printer according to claim 3, wherein the platen unit is provided with a biasing member for biasing the detected member toward the predetermined position.

8. A printer according to claim 4, wherein the platen unit is provided with a biasing member for biasing the detected member toward the predetermined position.

9. A printer according to claim 1, wherein the detected member comprises a base piece and a protruding piece protruding from an end part of the base piece for operating the sensor to ON and OFF positions; and further comprising a biasing member for biasing the detected member in a direction toward a cutting edge of the fixed blade.

10. A printer comprising:

a platen unit having a platen roller for advancing recording paper;

a head unit having a thermal head provided with a plurality of heating elements, the head unit being detachably combined with the platen unit;

a fixed blade mounted on the platen unit;

a movable blade mounted on the head unit to undergo sliding movement with respect to the fixed blade to a cutting position for cutting the recording paper, the movable blade being movable between the cutting position and an initial position in which the movable blade is away from the cutting position; and a sensor mounted on the head unit for detecting that the movable blade is at the initial position and for detecting a setting state of the platen roller corresponding to a state in which the head unit is detachably combined with the platen unit.

11. A printer according to claim 10, further comprising a detected member mounted on the platen unit and configured to be detected by the sensor to detect that the movable blade is at the initial position and to detect the setting state of the platen roller, the detected member being disposed at a predetermined position of the head unit when the head unit is detachably combined with the platen unit.

12. A printer according to claim 11, wherein the detected member comprises a base piece and a protruding piece protruding from an end part of the base piece for operating the sensor to ON and OFF positions; and further comprising a biasing member for biasing the detected member in a direction toward a cutting edge of the fixed blade.

13. A printer according to claim 11, wherein the detected member is slidable together with the movable blade.

14. A printer according to claim 13, wherein the platen unit is provided with a biasing member for biasing the detected member toward the predetermined position.

15. A printer according to claim 11, wherein the detected member is rotatably supported by the platen unit and rotates with the sliding movement of the movable blade.

16. A printer according to claim 15, wherein the platen unit is provided with a biasing member for biasing the detected member toward the predetermined position.

17. A printer according to claim 15, wherein the detected member is arranged coaxially with the platen roller and is rotatable independently from the platen roller as the movable blade slides.

18. A printer according to claim 17, wherein the platen unit is provided with a biasing member for biasing the detected member toward the predetermined position.

19. A printer according to claim 10, further comprising a member mounted on the platen unit and comprising a base piece and a protruding piece protruding from the base piece for operating the sensor to detect that the movable blade is at the initial position and to detect the setting state of the platen roller.

20. A printer comprising:

a platen unit having a platen roller for advancing recording paper;

a head unit having a thermal head provided with a plurality of heating elements, the head unit being detachably combined with the platen unit;

a fixed blade mounted on the platen unit;

a movable blade mounted on the head unit to undergo sliding movement with respect to the fixed blade to a cutting position for cutting the recording paper, the movable blade being movable between the cutting position and an initial position in which the movable blade is away from the cutting position;

a detected member mounted on the platen unit and configured to engage the movable blade for sliding movement therewith when the head unit is detachably combined with the platen unit; and one sensor mounted on the head unit for detecting the detected member to detect both a position of the movable blade and a setting state of the platen roller corresponding to a state in which the head unit is detachably combined with the platen unit.

* * * * *